US008953006B2

(12) United States Patent
Miyamura et al.

(10) Patent No.: US 8,953,006 B2
(45) Date of Patent: Feb. 10, 2015

(54) THERMAL HEAD AND THERMAL PRINTER PROVIDED WITH SAME

(75) Inventors: Kenji Miyamura, Kirishima (JP); Tadashi Hamayumiba, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/007,590

(22) PCT Filed: Mar. 23, 2012

(86) PCT No.: PCT/JP2012/057499

§ 371 (c)(1),
(2), (4) Date: Sep. 25, 2013

(87) PCT Pub. No.: WO2012/133178

PCT Pub. Date: Oct. 4, 2012

(65) Prior Publication Data

US 2014/0022325 A1 Jan. 23, 2014

(30) Foreign Application Priority Data

Mar. 25, 2011 (JP) ..... 2011-068184

(51) Int. Cl.
*B41J 2/335* (2006.01)
*B41J 2/345* (2006.01)

(52) U.S. Cl.
CPC ..... *B41J 2/33515* (2013.01); *B41J 2/33505* (2013.01); *B41J 2/345* (2013.01); *B41J 2/3351* (2013.01); *B41J 2/3354* (2013.01); *B41J 2/3357* (2013.01)
USPC ..... 347/208

(58) Field of Classification Search
USPC ..... 347/200, 208, 209, 210, 211
See application file for complete search history.

(56) References Cited

U.S. PATENT DOCUMENTS 5,162,191 A * 11/1992 Sedberry ..... 430/198
5,317,342 A * 5/1994 Sedberry ..... 347/141
5,416,502 A * 5/1995 Sedberry ..... 347/172
5,488,394 A * 1/1996 Sedberry ..... 346/141
5,624,708 A * 4/1997 Sedberry ..... 427/126.2

FOREIGN PATENT DOCUMENTS

JP 2-151452 * 6/1990 ..... 347/209
JP 5-031955 * 2/1993 ..... 347/237
JP 2000286291 A 10/2000

OTHER PUBLICATIONS

International Search Report, PCT/JP2012/057499, Apr. 9, 2012, 2 pp.

* cited by examiner

*Primary Examiner* — Huan Tran
(74) *Attorney, Agent, or Firm* — Volpe and Koenig, P.C.

(57) ABSTRACT

A thermal head and a printer head are disclosed. The thermal head includes heat generating members, a drive IC disposed, pads and interconnection lines which are all disposed on a substrate. The heat generating members are arranged in a first direction. The drive IC is operable to control driving of the heat generating members. The pads are operable to being electrically connected to terminals of the drive IC. The interconnection lines electrically connect each of the heat generating members to one of the pads. The pads are arranged in a first direction and constitute first pad groups and second pad groups constituted by the pads that constitute the first pad groups. The second pad groups are arranged in the first direction so as to be shifted from each other in a second direction that differs from the first direction.

15 Claims, 11 Drawing Sheets

3
X1
7d
13b
7a
17b
23b(23bE)
23
23a(23aE)
9
21
17c
29
17(17a)
23aM
23bM
9
19
29
17c
23aM
23bM
19
7b
17c
29
9
21
L
19
23a(23aE)
23
13b
23b(23bE)
7c
17b
W

3
X1
5
13b
7a
17b
23b(23bE)
23a(23aE)
23
9
21E
21N
17c
11
17(17a)
31
21M
9
23bM
19
21L
17c
11
23aM
5
19
17c
21N
21E
9
23a(23aE)
19
23
23b(23bE)
L
W
13b
1a
17b

THERMAL HEAD AND THERMAL PRINTER PROVIDED WITH SAME

FIELD OF INVENTION

The present invention relates to a thermal head and a thermal printer including the same.

BACKGROUND

A variety of thermal heads have been developed as a printing device of, for example, a facsimile and a video printer. For example, PTL 1 describes a thermal head including a substrate, a plurality of heat generating members arranged on the substrate, a plurality of interconnection lines for supplying electric currents to the heat generating members, and a drive IC for controlling power supplied to the heat generating members. In addition, end portions of the plurality of interconnection lines have a plurality of pads, which are used for being connected to a plurality of terminals of the drive IC, formed therein.

In the thermal head described in PTL 1, since the plurality of heat generating members are densely arranged, the plurality of pads formed in the plurality of interconnection lines connected to the respective heat generating members are also densely arranged on the substrate in limited space. More specifically, the pads are disposed so that the lengths of the interconnection lines connected to the pads gradually increase and, thus, the pads are disposed so as to extend diagonally.

CITATION LIST

Patent Literature

PTL 1: Japanese Unexamined Patent Application Publication No. 2000-286291

SUMMARY

Technical Problem

However, a problem arises in the thermal head described in PTL 1; since, as described above, the pads are disposed so as to extend diagonally, the length of each of the pads in the arrangement direction increases. As a result, the length of the substrate in the arrangement direction of the pads increases and, thus, the size of the thermal head increases.

Solution to Problem

According to an embodiment of the present invention, a thermal head includes a substrate, a plurality of heat generating members disposed on the substrate and arranged in a first direction, a drive IC disposed on the substrate and configured to control driving of the heat generating members, a plurality of pads disposed on the substrate, where the pads are electrically connected to a plurality of terminals of the drive IC, and a plurality of interconnection lines disposed on the substrate and configured to electrically connect each of the heat generating members to one of the pads. The pads are arranged in a first direction and constitute a plurality of first pad groups and a plurality of second pad groups constituted by the pads that constitute the first pad groups, and the second pad groups are arranged in the first direction so as to be shifted from each other in a second direction that differs from the first direction.

According to another embodiment of the present invention, a thermal printer includes the above-described thermal head, a transport mechanism configured to transport a medium to a point above the plurality of heat generating members, and a platen roller configured to urge the medium against the heat generating members.

Advantageous Effects of Invention

EFFECTS OF INVENTION

According to the present invention, even when the pads for being connected to the connection terminals of the drive IC are densely disposed, a compact thermal head and a thermal printer including the thermal head can be provided.

DETAILED DESCRIPTION OF THE PREFERRED EMBODIMENTS

First Embodiment

Figure 1:
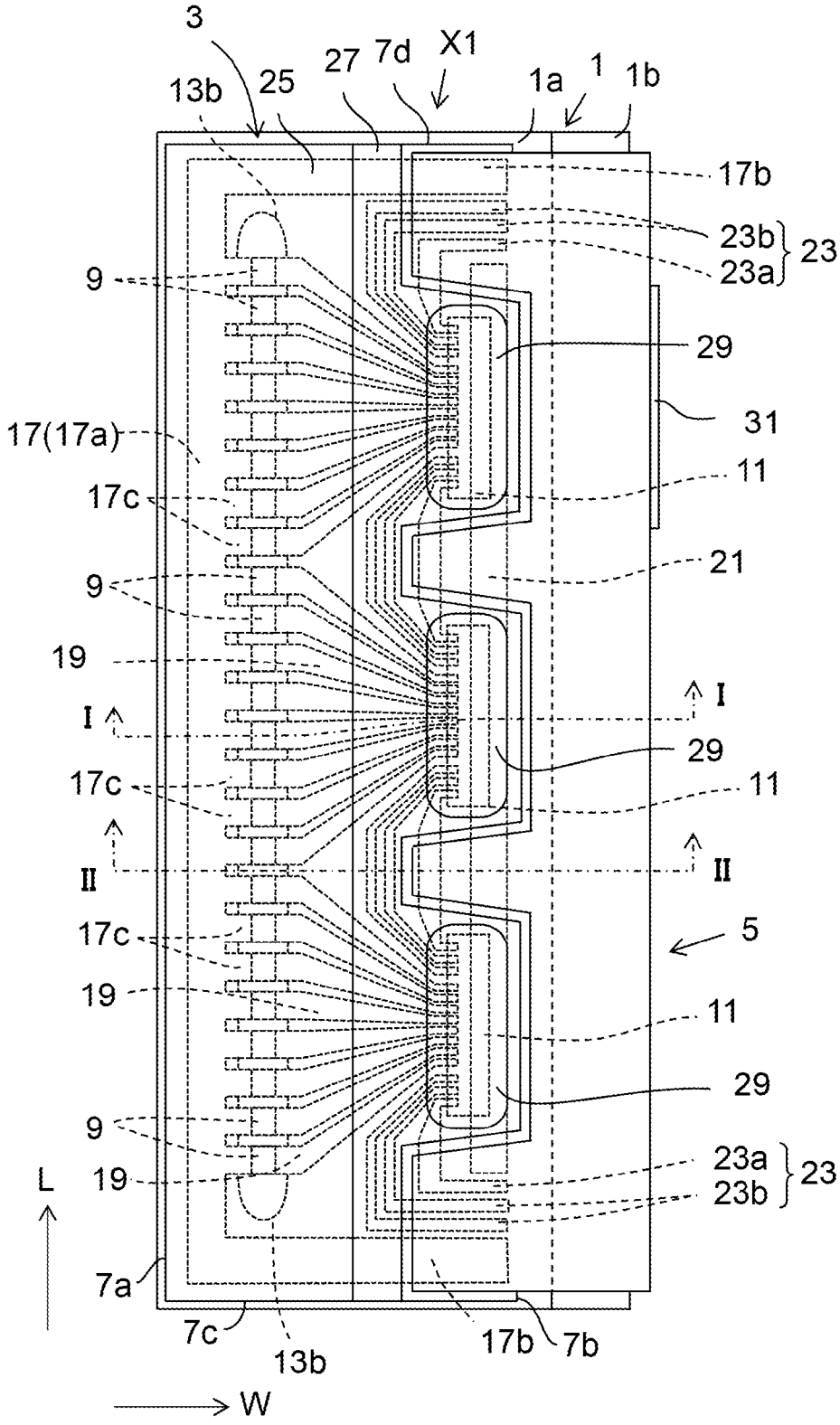
FIG. 1 is a plan view of a thermal head according to an embodiment of the present invention.
Figure 2:
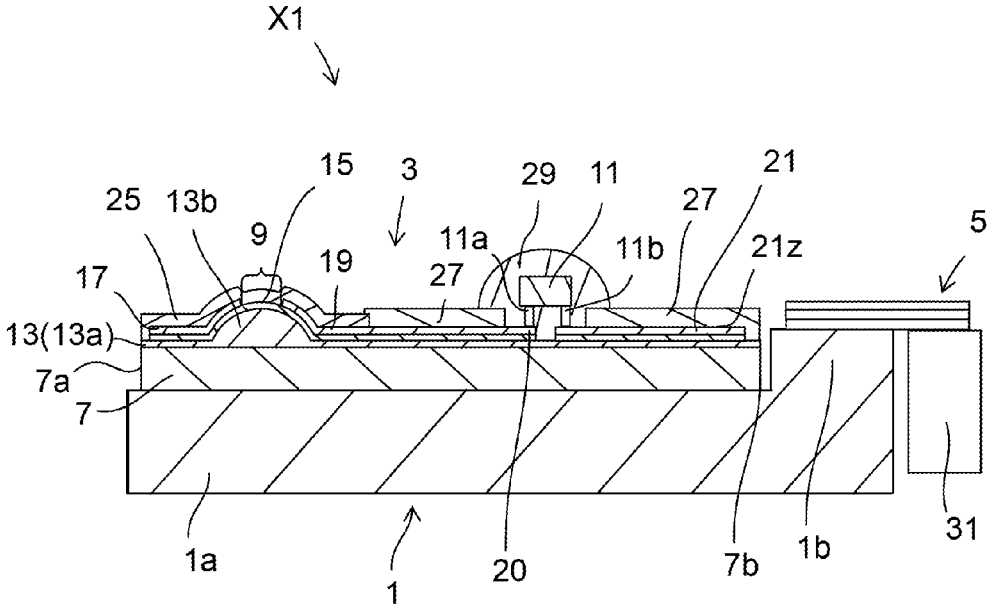
FIG. 2 is a cross-sectional view of the thermal head taken along a line I-I of FIG. 1.
Figure 3:
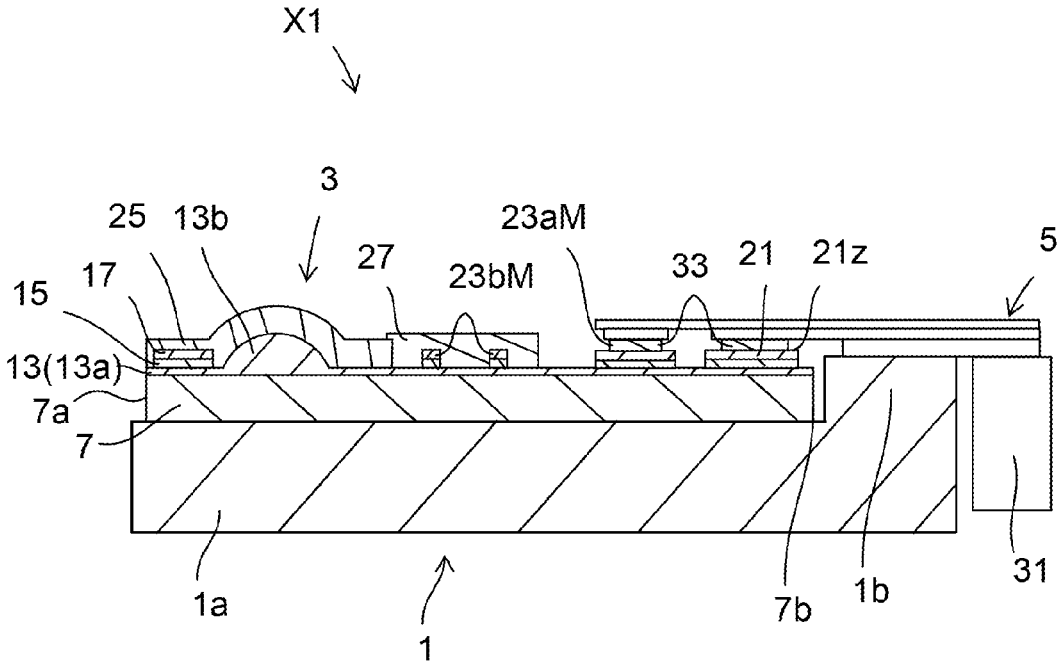
FIG. 3 is a cross-sectional view of the thermal head taken along a line II-II of FIG. 1.
Figure 4:
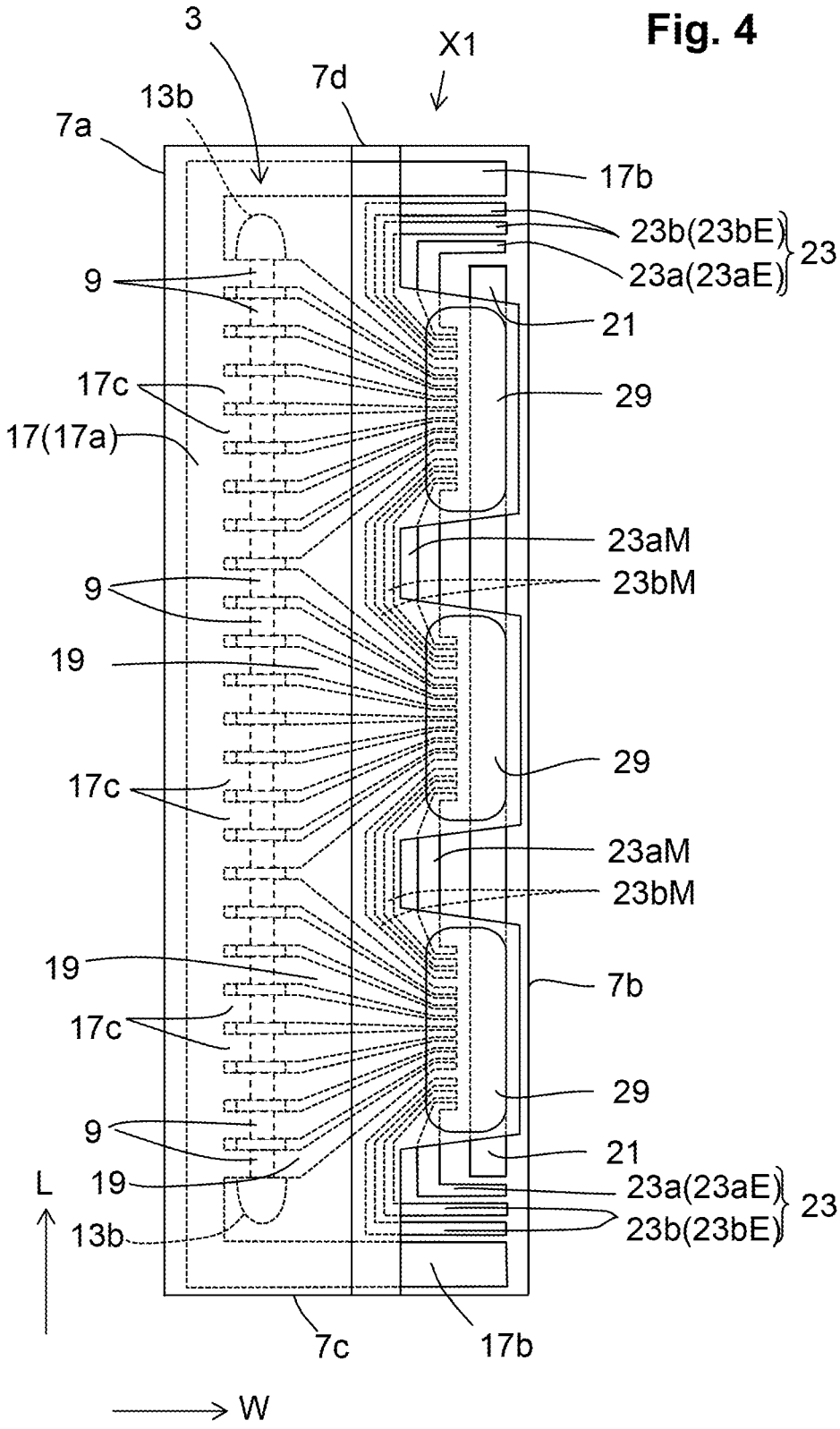
FIG. 4 is a plan view of a head substrate of the thermal head in FIG. 1.

A thermal head X1 according to a first embodiment of the present invention is described below with reference to the accompanying drawings. As illustrated in FIGS. 1 to 3, the thermal head X1 includes a heat dissipator 1, a head substrate 3 disposed on the heat dissipator 1, and a flexible printed circuit board 5 (hereinafter referred to as an "FPC 5") connected to the head substrate 3.

The heat dissipator 1 is made of a metallic material, such as copper or aluminum, and includes a baseplate portion 1*a* having a rectangular shape in plan view and a protrusion portion 1*b* protruding along one of the long sides of the baseplate portion 1*a*. As illustrated in FIG. 2, the head substrate 3 is bonded to the top surface of the baseplate portion 1*a* other than the area of the protrusion portion 1*b* using a double-sided adhesive tape, an adhesive agent (not illustrated), or the like. In addition, the FPC 5 is bonded to the protrusion portion 1*b* using a double-sided adhesive tape, an adhesive agent (not illustrated), or the like. Furthermore, as described below, of the heat generated by a heat generating members 9 of the head substrate 3, the heat dissipator 1 has a function of dissipating part of the heat that is not used for printing.

As illustrated in FIGS. 1 to 5, the head substrate 3 includes a substrate 7 having a rectangular shape in plan view, a plurality of the heat generating members 9 disposed on the substrate 7 and arranged in the length direction, which is a first direction L, of the substrate 7, and a plurality of drive IC's 11 arranged on the substrate 7 in the arrangement direction of the heat generating members 9.

The substrate 7 has one long side 7*a*, the other long side 7*b*, one short side 7*c*, and the other short side 7*d*, and is made of an electrically insulating material, such as alumina ceramic, or a semiconductor material, such as a single crystal silicon.

Figure 5:
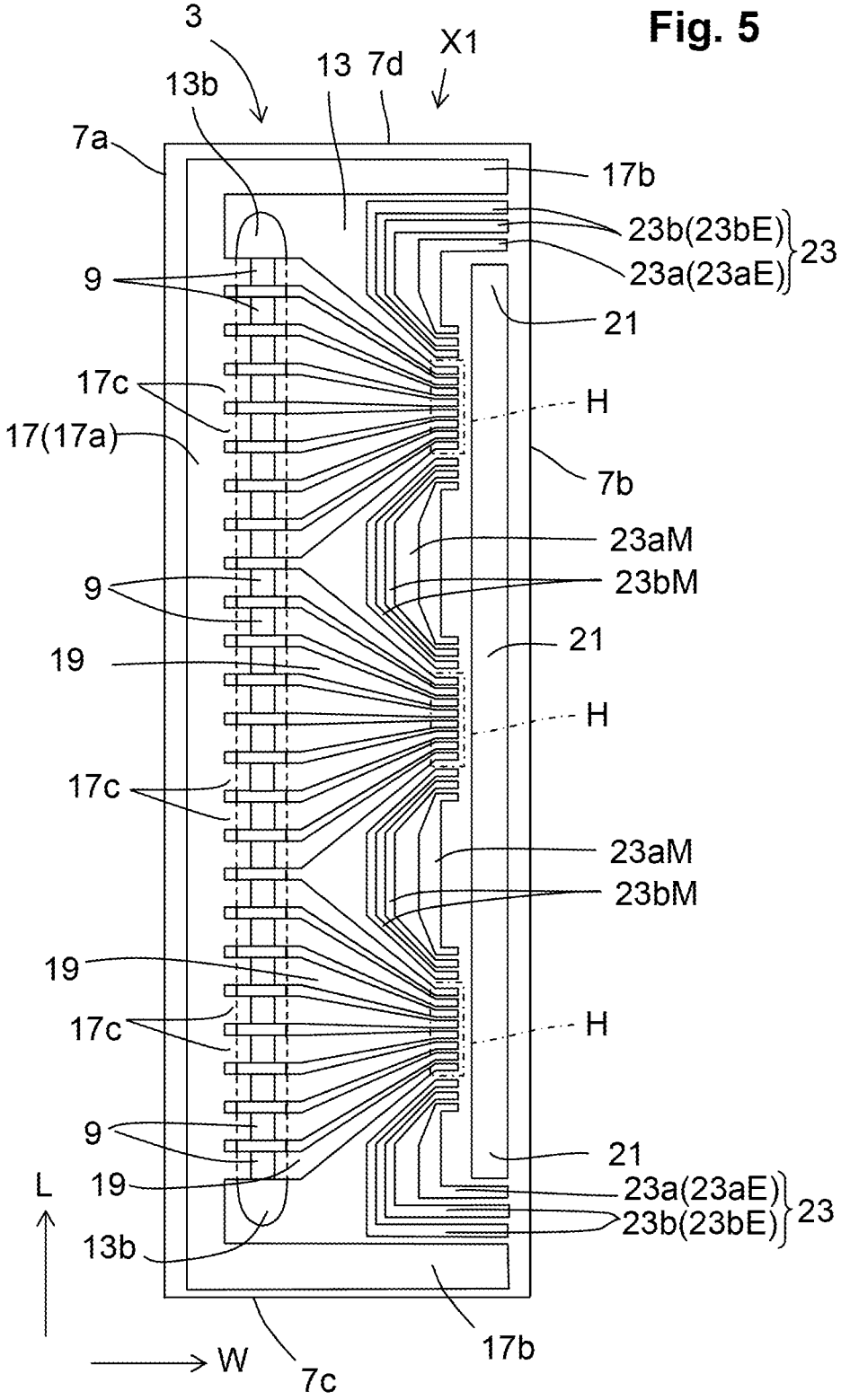
FIG. 5 is a plan view of the head substrate in FIG. 4 with a first protective layer, a second protective layer, a drive IC, and a covered member removed.

As illustrated in FIGS. 2, 3, and 5, a thermal storage layer 13 is formed on the top surface of the substrate 7. The thermal storage layer 13 includes an underlayer 13*a* and a raised portion 13*b*. The underlayer 13*a* is formed on the entirety of the top surface of the substrate 7. The raised portion 13*b* is partially raised from the underlayer 13*a* and extends in the first direction L in a band shape, and the cross-sectional shape of the raised portion 13*b* is substantially semi-elliptical. The raised portion 13*b* urges a print medium against a first protective layer 25 formed on the heat generating members 9 in an optimum manner.

The thermal storage layer 13 can be formed of, for example, glass having a low heat conductivity, and temporarily accumulates part of heat generated by the heat generating members 9. Thus, it is functioned that the time required for raising the temperature of the heat generating members 9 can be reduced, and the thermal responsiveness of the thermal head X1 can be improved.

The glass that forms the thermal storage layer 13 can be formed by applying predetermined glass paste obtained by mixing an appropriate organic solvent with glass powders onto the top surface of the substrate 7 using an existing technique (e.g., screen printing) and, thereafter, firing the substrate 7 at a high temperature. Examples of the glass used for forming the thermal storage layer 13 include glass containing SiO2, Al2O3, CaO, and BaO, glass containing SiO2, Al2O3, and PbO, glass containing SiO2, Al2O3, and BaO, and glass containing SiO2, B2O3, PbO, Al2O3, CaO, and MgO.

An electrical resistance layer 15 is formed on the top surface of the thermal storage layer 13. The electrical resistance layer 15 is located between the thermal storage layer 13 and a common electrode interconnection line 17 (described in more detail below), individual electrode interconnection lines 19, a ground electrode interconnection line 21 and IC control interconnection lines 23. As illustrated in FIG. 5, the electrical resistance layer 15 has areas (hereinafter referred to "intervening areas") having the same shapes as the IC control interconnection line 19, the common electrode interconnection line 17, the ground electrode interconnection line 21, and the IC control interconnection lines 23 in plan view. In addition, the electrical resistance layer 15 has a plurality of areas (hereinafter referred to "exposed areas") that are exposed between the common electrode interconnection line 17 and each of the individual electrode interconnection lines 19. Note that in FIG. 5, the intervening areas of the electrical resistance layer 15 are covered and hidden by the common electrode interconnection lines 17, each of the individual electrode interconnection lines 19, the ground electrode interconnection line 21, and the IC control interconnection lines 23.

The exposed areas of the electrical resistance layer 15 form the heat generating members 9. As illustrated in FIGS. 2 and 5, the heat generating members 9 are located above the raised portion 13*b* of the thermal storage layer 13 and are arranged in a first direction indicated by an arrow L (hereinafter referred to as a "first direction L"). The plurality of heat generating members 9 are illustrated in a simplified form in FIGS. 1, 4, and 5, for convenience of description, but are arranged at a density of, for example, 180 to 2400 dpi (dot per inch).

The electrical resistance layer 15 is made of a material having a relatively high electrical resistance, such as a TaN based material, a TaSiO based material, a TaSiNO based material, a TiSiO based material, a TiSiCO based material, or a NbSiO based material. Accordingly, when a voltage is applied between the common electrode interconnection line 17 and one of the individual electrode interconnection lines 19 and, thus, an electric current is supplied to one of the heat generating members 9, the one of the heat generating members 9 generates heat due to Joule Heating.

As illustrated in FIGS. 1 to 6, the common electrode interconnection lines 17, the individual electrode interconnection lines 19, the ground electrode interconnection line 21, and the IC control interconnection lines 23 are provided on the top surface of the electrical resistance layer 15. The common electrode interconnection lines 17, the individual electrode interconnection lines 19, the ground electrode interconnection line 21, and the IC control interconnection lines 23 are made of a conductive material, and are made of, for example, one of metals, such as aluminum, gold, silver, and copper, or an alloy of these metals.

Figure 6:
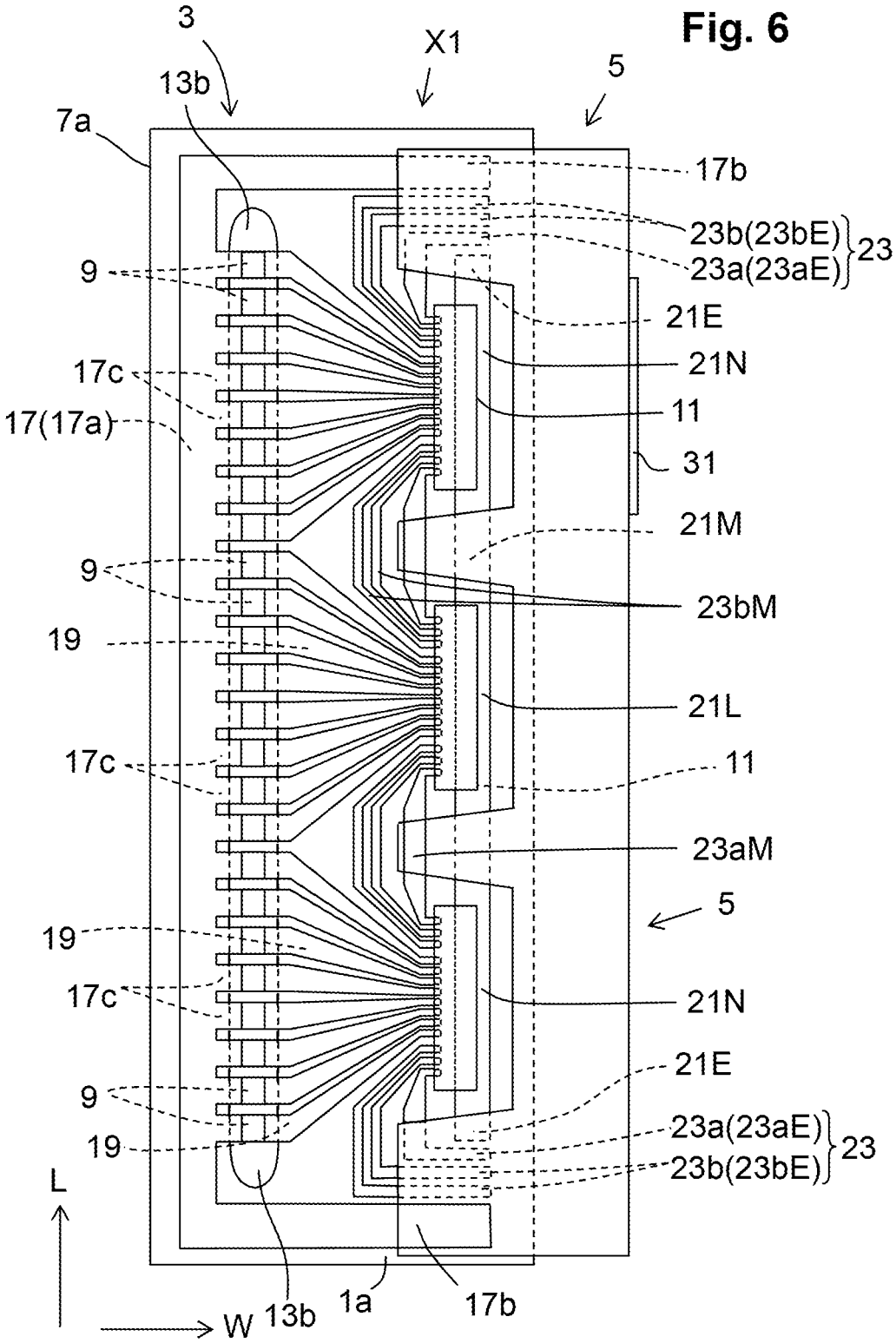
FIG. 6 is a plan view illustrating connection of an FPC to the head substrate with the first protective layer, the second protective layer, and the covered member removed.

As illustrated in FIG. 5, the common electrode interconnection line 17 includes a main interconnection line portion 17*a*, sub interconnection line portions 17*b*, and lead portions 17*c*. The main interconnection line portion 17*a* extends along the one long side 7*a* of the substrate 7. The sub interconnection line portions 17*b* extend along the one short side 7*c* and the other short side 7*d* of the substrate 7. One end of each of the sub interconnection line portions 17*b* is connected to the main interconnection line portion 17*a*. The lead portions 17*c* extend from the main interconnection line portion 17*a* to each of the heat generating members 9. In addition, as illustrated in FIG. 6, the other end of each of the sub interconnection line portions 17*b* is connected to the FPC 5, and also the top end of each of the lead portions 17*c* is connected to the heat generating members 9. In this manner, the FPC 5 is electrically connected to the heat generating members 9.

Figure 7:
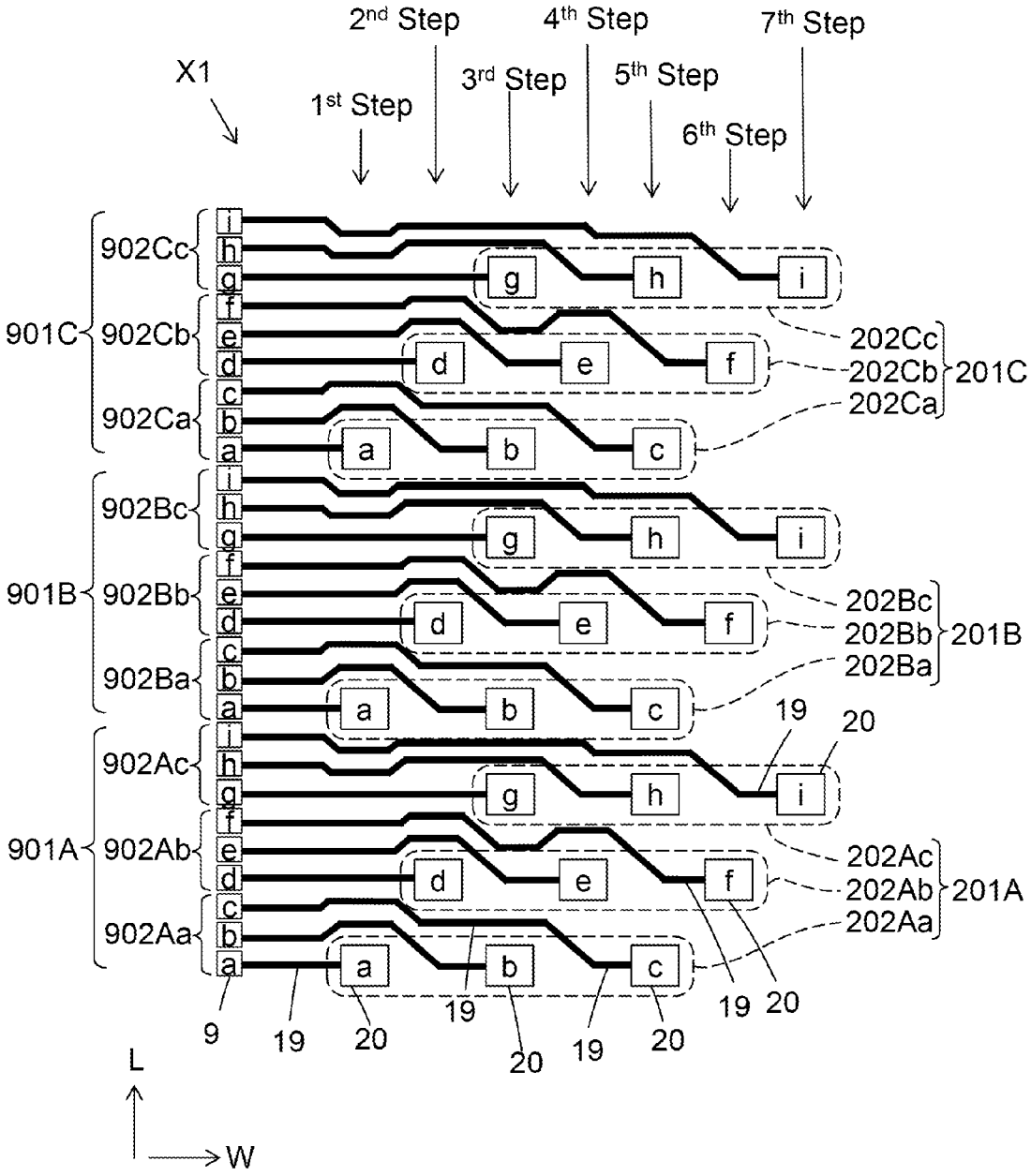
FIG. 7 is an enlarged view of an area corresponding to an H portion in FIG. 5.

As illustrated in FIGS. 2, 6, and 7, each of the individual electrode interconnection lines 19 extends between each of the heat generating members 9 and one of drive IC's 11, thereby electrically connecting these. More specifically, each of the individual electrode interconnection lines 19 connects each of the heat generating members 9 to one of the pads 20. In addition, the individual electrode interconnection lines 19 separate the heat generating members 9 into a plurality of groups and electrically connect the heat generating members 9 in each group to one of the drive IC's 11 that corresponds to the group. Note that, in the present embodiment, the individual electrode interconnection lines 19 correspond to interconnection lines of the present invention.

As illustrated in FIG. 5, the ground electrode interconnection line 21 extends in the arrangement direction of the heat generating members 9 in a band shape in the vicinity of the other long side 7*b* of the substrate 7. As illustrated in FIGS. 3 and 6, the FPC 5 and the drive IC's 11 are connected to the ground electrode interconnection line 21. More specifically, as illustrated in FIG. 6, the FPC 5 is connected to end areas 21E located at one and other ends of the ground electrode interconnection line 21. In addition, the FPC 5 is connected to first middle areas 21M of the ground electrode interconnection line 21 that are located between two neighboring drive IC's 11. Each of the drive IC's 11 is connected to any one of second intermediate areas 21N that are located between one of the end areas 21E and one of the first middle areas 21M, and connected to a third intermediate area 21L that is located between the neighboring first middle areas 21M. In this manner, the drive IC's 11 are electrically connected to the FPC 5.

As illustrated in FIG. 6, each the drive IC's 11 is disposed so as to correspond to one of the groups of the heat generating members 9, and is connected to one end portion of each of the individual electrode interconnection lines 19 and the ground electrode interconnection line 21. The drive IC 11 controls the current-carrying state of the heat generating members 9, and includes a plurality of switching elements therein as described below. An existing one, which enters a current-carrying state when each of the switching elements is in an ON mode and enters a non-current-carrying state when each of the switching elements is in an OFF mode, can be used as the drive IC 11. As illustrated in FIG. 2, each of the drive IC's 11 includes a connection terminal 11*a* (hereinafter referred to as a "first connection terminal 11*a*"), which is connected to one of the internal switching elements (not illustrated). The first connection terminal is connected to the individual electrode interconnection lines 19. In addition, in the drive IC 11, the other connection terminal 11*b* (hereinafter referred to as a "second connection terminal 11*b*"), which is connected to the internal switching element, is also connected to the ground electrode interconnection line 21. Thus, when one of the switching elements is in an ON mode, each of the individual electrode interconnection lines 19 that is connected to each of the switching elements is electrically connected to the ground electrode interconnection line 21.

Although not illustrated, a plurality of first connection terminals 11*a* connected to the individual electrode interconnection lines 19 and a plurality of second connection terminals 11*b* connected to the ground electrode interconnection line 21 is provided so as to correspond to each of the individual electrode interconnection lines 19. The plurality of first connection terminals 11*a* are connected to the individual electrode interconnection lines 19 in one-to-one correspondence. In contrast, the plurality of second connection terminals 11*b* is all connected to the ground electrode interconnection line 21. Note that the first connection terminals 11*a* according to the present embodiment correspond to connection terminals of the present invention.

Connection between the first connection terminal 11*a* of the drive IC 11 and the individual electrode interconnection lines 19 is described in detail below. As described above, for convenience of description, the plurality of heat generating members 9 are simplified to be illustrated in FIG. 5, and is actually arranged at a density of, for example, 180 to 2400 dpi (dot per inch). Accordingly, connection between the first connection terminal 11*a* of the drive IC 11 and the individual electrode interconnection lines 19 in the case in which the plurality of heat generating members 9 are arranged at a high density is described with reference to FIG. 7.

FIG. 7 is an enlarged view of an area corresponding to an H portion in FIG. 5. In FIG. 7, the individual electrode interconnection lines 19 are indicated by thick solid lines. For components having the same or similar configuration, for example, the same reference numeral with suffixes of different upper-case letters may be added like "first heat generating member groups 901A, 901B, and 901C"). Alternatively, in such a case, the suffixes may be removed simply like "heat generating member groups 901").

In the present embodiment, as illustrated in FIG. 7, a pad 20 is connected to the end portion of each of the individual electrode interconnection lines 19 and, thus, the first connection terminal 11*a* of the drive IC 11 provided on the pad 20 is connected to the individual electrode interconnection lines 19 via, for example, solder paste (refer to FIG. 2). The pad 20 has a width that is greater than the line width of the individual electrode interconnection lines 19 so as to have a width that allows the first connection terminal 11*a* to be connected thereto using, for example, solder paste. Not that in order to increase the joint strength between the first connection terminal 11*a* of the drive IC 11 and the pad 20, nickel or gold may be plated on the surface of the pad 20.

The heat generating members 9 are sequentially arranged in the first direction L, and each of the first heat generating member groups 901A, 901B, and 901C is constituted by some of the sequentially arranged heat generating members 9. In the first heat generating member group 901A, second heat generating member groups 902Aa, 902Ab, and 902Ac are constituted by a plurality of heat generating members 9 that constitute the first heat generating member group 901A. In the first heat generating member group 901B, second heat generating member groups 902Ba, 902Bb, and 902Bc are constituted by a plurality of heat generating members 9 that constitute the first heat generating member group 901B. In the first heat generating member group 901C, second heat generating members 902Ca, 902Cb, and 902Cc are constituted by a plurality of heat generating members 9 that constitute the first heat generating member group 901C.

The plurality of pads 20 are arranged in the first direction L, and include first pad groups 201A, 201B, and 201C that are constituted by a plurality of pads 20. In the first pad group 201A, second pad groups 202Aa, 202Ab, and 202Ac are constituted by a plurality of pads 20 that constitute the first pad group 201A. In the first pad group 201B, second pad groups 202Ba, 202Bb, and 202Bc are constituted by a plurality of pads 20 that constitute the first pad group 201B. In the first pad group 201C, second pad groups 202Ca, 202Cb, and 202Cc are constituted by a plurality of pads 20 that constitute the first pad group 201C.

Arrangement of the pads 20 is described below with reference to the first pad group 201A. Each of the second pad groups 202Aa, 202Ab, and, 202Ac is constituted by the pads 20 arranged in a second direction W. More specifically, the second pad group 202Aa is constituted by pads 20*a*, 20*b*, and 20*c*. The second pad groups 202Aa, 202Ab, and, 202Ac are arranged in the first direction L. In addition, the second pad groups 202Aa, 202Ab, and, 202Ac are arranged so as to be offset from each other in the second direction W. Thus, the pads 20 that constitute a second pad group 202 are provided in a staircase pattern in which the distances from the heat generating members 9 vary in stepwise manner.

In this manner, the pads 20 that constitute each of the second pad groups 202 are arranged in the second direction W, and the second pad groups 202 are arranged in the first direction L. Accordingly, the arrangement area of the pads 20 in the second direction W can be reduced, as compared with the configuration in which the pads 20 are arranged diagonally. As a result, the length of the substrate 7 in the second direction W can be reduced and, thus, the size of the thermal head X1 can be reduced. In addition, since pads constituting the second pad groups 202 are arranged in the second direction W, the arrangement area of the pads 20 in the first direction L can be also reduced. As a result, the length of the substrate 7 in the first direction L can be reduced and, thus, the size of the thermal head X1 can be reduced even in the first direction L. This is particularly effective for the thermal head X1 of a high density interconnection line type for which the arrangement area of the pads 20 tends to increase due to a large number of the pads 20.

Since the arrangement area of the pads 20 of the thermal head X1 can be reduced in the second direction W, the distance between the heat generating members 9 and the pad 20 can be reduced, as compared with the existing technology in which the pad 20 are diagonally arranged. More specifically, the distance between the pad 20*i* located in a seventh step that is far from the heat generating members 9 and a heat generating members 9*i* can be reduced, as compared with the existing technology. In this manner, the distance between the pad 20*i* located in the seventh step that is far from the heat generating members 9*i* and the heat generating members 9 can be made close to the distance between the pad 20*a* located in a first step that is close to the heat generating members 9 and a heat generating members 9*a*.

Accordingly, the length of the individual electrode interconnection lines 19 that electrically connects the heat generating members 9*i* to the pad 20*i* can be made close to the length of the individual electrode interconnection lines 19 that electrically connects the heat generating members 9*a* to the pad 20*a*. Consequently, a difference in the electrical resistance of the individual electrode interconnection lines 19 between the heat generating members 9*a* and the heat generating members 9*i* can be made small. As a result, a difference in the heating temperature among the heat generating members 9 can be reduced.

In the thermal head X1, the second pad groups 202 are disposed so as to be offset from each other in the first direction L. That is, the second pad groups 202 are disposed so as to move away from the heat generating members 9. Accordingly, even when a large number of the pads 20 are disposed, the individual electrode interconnection lines 19 can be disposed at a high density. That is, by disposing only the pad 20*a* of the second pad group 202Aa in the first step, disposing only a pad 20*d* of the second pad group 202Ab in the second step, and disposing the pad 20*b* of the second pad group 202Aa and a pad 20*g* of the second pad group 202Ac in the third step where the need for the space for the individual electrode interconnection lines 19 for the pads 20*a* and 20*d* is eliminated, the pads 20 and the individual electrode interconnection lines 19 can be disposed at a high density. In this manner, the size of the thermal head X1 can be reduced more in the first direction L.

As illustrated in FIG. 7, in the thermal head X1, first pad groups 201 are arranged in the first direction L. In addition, in each of the first pad groups 201, the second pad groups 202 are arranged in the first direction L so as to be offset from each other in the second direction W. That is, the first pad group 201 has a particular pad arrangement pattern, and the particular pad arrangement pattern is repeatedly provided in the first direction L.

As described above, since the first pad groups 201 have the particular pad arrangement pattern and a plurality of the first pad groups 201 are arranged in the first direction L, in a probe process in which electrical connection between the heat generating members 9 and the pad 20 is detected, a tact time of the probe process can be reduced. That is, by producing probe needles that match the particular pad arrangement pattern of the first pad groups 201 and performing the probe process for each of the first pad groups 201, the tact time required for the probe process can be reduced, as compared with the probe process performed for each of the pad 20.

The arrangement of the pads 20 is described in more detail below with reference to the first pad group 201A.

When viewed in the first direction L, in the neighboring second pad groups 202Aa and 202Ab of the thermal head X1, the pad 20*d* in the second pad group 202Ab is disposed between the pads 20*a* and 20*b* in the second pad group 202Aa, and the pad 20*d* in the second pad group 202Ab is disposed between the pads 20*b* and 20*c* that constitute the second pad group 202Aa. Accordingly, the arrangement area of the pads 20 in the first direction L can be reduced. In the thermal head X1 illustrated in FIG. 7, the second pad group 202Ac of the first pad group 201A including pads 20*g*, 20*h* and 20*i* the second pad group 202Ba of the first pad group 201B including pads 20*a*, 20*b* and 20*c* are located next to each other. However, the pads 20*a*, 20*b*, and 20*c* of the second pad group 202Ba of the first pad group 201B are disposed between the pads 20*g* and 20*h* and between the pads 20*h* and 20*i* of the second pad group 202Ac of the first pad group 201A, respectively. In such a case, the arrangement area of the pads 20 can be reduced more. Note that in this case, the first pad group 201B can be shifted in the second direction W by one step. Accordingly, each of the first pad groups 201A and 201C can be shifted from the neighboring first pad group 201B.

In addition, each of the distances between the pad 20*a*, 20*d* and 20*g* which are located so as to be the closest to the heat generating members 9 in each of the second pad groups 202Aa, 202Ab, and 202Ac, and the heat generating members 9*a*, 9*d* and 9*g*, respectively, increase as moving toward the first direction L. Accordingly, the lengths of the individual electrode interconnection lines 19 that connects the neighboring heat generating members 9*c* and 9*d* to the second pad group 202Aa and 202Ab can be made close. That is, the distance between the heat generating members 9*c* and the pad 20*c* that constitutes the second pad group 202Aa can be made close to the distance between the heat generating members 9*d* and the pad 20*d* that constitutes the second pad group 202Ab, and therefore, the electrical resistances of the individual electrode interconnection lines 19 for the neighboring heat generating members 9*c* and 9*d* can be made close to each other. Consequently, the heating temperatures of the neighboring heat generating members 9*c* and 9*d* can be made close to each other. Note that the neighboring heat generating members 9 indicate the heat generating members 9 that are disposed next to each other in the first direction L, and a voltage is sequentially applied when printing is performed.

Note that the first direction L represents the arrangement direction of the heat generating members 9, and the second direction W represents a direction that is different from the first direction L and is preferably a direction perpendicular to the first direction L. Also, "the second direction W is perpendicular to the first direction L" means that the angle formed by the first direction L and the second direction W is not limited to exactly 90 degrees, but that the angle has an allowance of about 5 degrees.

The IC control interconnection lines 23 are provided to control the drive IC's 11, and each IC control interconnection line 23 includes an IC power supply interconnection line 23*a* and an IC signal interconnection line 23*b* as illustrated in FIGS. 5 and 6. Each IC power supply interconnection line 23*a* includes an end power supply electrode portions 23*a*E and a middle power supply electrode portions 23*a*M. The end power supply electrode portions 23*a*E are disposed at both ends of the substrate 7 in a longitudinal direction of the substrate 7 near the right long side of the substrate 7. The middle power supply electrode portions 23$a$M are disposed between the neighboring drive IC's 11.

As illustrated in FIG. 6, in the end power supply electrode portion 2$a$E, one end is disposed below the drive IC's 11, and the other end is disposed in the vicinity of the other long side 7$b$ of the substrate 7 while the end power supply electrode portion 23$a$E extends around the periphery of the ground electrode interconnection line 21. One end of the end power supply electrode portion 23$a$E is connected to the drive IC 11, and the other end is connected to the FPC 5. Thus, the drive IC 11 and the FPC 5 are electrically connected.

As illustrated in FIG. 6, the middle power supply electrode portion 23$a$M extends along the ground electrode interconnection line 21L, 21N and 21E, and one end is disposed in one of the arrangement areas of the neighboring drive IC 11 and the other end is disposed in the other arrangement area of the neighboring drive IC 11. In the middle power supply electrode portion 23$a$M, one end is connected to one of the neighboring drive IC's 11, and the other end is connected to the other drive IC 11, and the middle portion is connected to the FPC 5 (refer to FIG. 3). In this manner, the drive IC 11 and the FPC 5 are electrically connected.

The end power supply electrode portion 23$a$E and the middle power supply electrode portion 23$a$M are electrically connected to each other inside the drive IC 11 to which both the portions are connected. In addition, the neighboring middle power supply electrode portions 23$a$M are electrically connected to each other inside the drive IC 11 to which both the portions are connected.

As described above, by connecting each IC power supply interconnection line 23$a$ to each of the drive IC's 11, the each IC power supply interconnection line 23$a$ electrically connects between the each drive IC's 11 and the FPC 5. In this manner, as described below, an electric current is supplied from the FPC 5 to each of the drive IC's 11 via the end power supply electrode portions 23$a$E and the middle power supply electrode portions 23$a$M.

As illustrated in FIGS. 5 and 6, each of the IC signal interconnection line 23$b$ includes: end signal interconnection line portions 23$b$E disposed at both ends of the substrate 7 in the longitudinal direction and in the vicinity of the other long side 7$b$ of the substrate 7, and middle signal interconnection line portions 23$b$M disposed between the neighboring drive IC's 11.

As illustrated in FIG. 6, like the end power supply electrode portions 23$a$E, the end signal interconnection line portions 23$b$E, one end is disposed in the arrangement area of the drive IC's 11, and the other end is disposed in the vicinity of the other long side 7$b$ of the substrate 7 while the end signal interconnection line portion 23$b$E extends along the periphery of the ground electrode interconnection line 21. The end signal interconnection line portions 23$b$E includes a one and another end, and the one end is connected to the drive IC 11, and the other end is connected to the FPC 5.

In the middle signal interconnection line portion 23$b$M, one end thereof is disposed on the arrangement area of one of the neighboring drive IC's 11, and extends around the periphery of the middle power supply electrode portion 23$a$M while the other end is disposed on the arrangement area of the other neighboring drive IC 11. In the middle signal interconnection line portion 23$b$M, one end thereof is connected to one of the neighboring drive IC's 11, and the other end is connected to the other neighboring drive IC 11.

The end signal interconnection line portion 23$b$E and the middle signal interconnection line portion 23$b$M are connected to each other inside the drive IC 11 to which both the portions are connected. In addition, the neighboring middle signal interconnection line portions 23$b$M are electrically connected to each other inside the drive IC to which both the portions are connected.

By connecting the IC signal interconnection lines 23$b$ to each of the drive IC's 11 in this manner, the IC signal interconnection lines 23$b$ electrically connect each of the drive IC 11 to the FPC 5. Thus, as described below, a control signal transmitted from the FPC 5 to the drive IC 11 via the end signal interconnection line portion 23$b$E is further transmitted to the neighboring drive IC 11 via the middle signal interconnection line portion 23$b$M.

Each of the above-described electrical resistance layer 15, common electrode interconnection line 17, individual electrode interconnection lines 19, ground electrode interconnection line 21, and IC control interconnection lines 23 can be formed by, for example, sequentially stacking, on the thermal storage layer 13, the material layers constituting each thereof using an existing thin film forming technique such as a sputtering method and, subsequently, and then by processing the stacked body into a predetermined pattern using an existing photolithography technique, an existing etching technique, or the like.

As illustrated in FIGS. 2 and 3, the first protective layer 25 is formed on the thermal storage layer 13 formed on the top surface of the substrate 7 so as to cover the heat generating members 9, a part of the common electrode interconnection line 17, and part of the individual electrode interconnection lines 19. In the example illustrated in the Figures, the first protective layer 25 is formed so as to extend in the arrangement direction of the heat generating members 9 and cover the substantially left half of the top surface of the thermal storage layer 13.

The first protective layer 25 can prevent part of the heat generating members 9, part of the common electrode interconnection line 17, and part of the individual electrode interconnection lines 19 which have been coated from being oxidized by the reaction with oxygen, can prevent them from being eroded due to, for example, adhesion of water in the air, and can reduce the possibility of wearing due to contact with a print medium. The first protective layer 25 can be formed from, for example, an SiC based material, an SiN based material, an SiO based material, an SiON based material, or the like. In addition, the first protective layer 25 can be formed using, for example, an existing thin film forming technique such as a sputtering technique or a vapor-deposition technique, or an existing thick film forming technique such as a screen printing technique. Note that the first protective layer 25 may be formed by stacking a plurality of material layers.

In addition, as illustrated in FIGS. 1 to 4, a second protective layer 27, which partially covers the common electrode interconnection line 17, the individual electrode interconnection lines 19, the IC control interconnection line 23, and the ground electrode interconnection line 21, is formed on the thermal storage layer 13 that is formed on the top surface of the substrate 7. In the example illustrated in the Figures, the second protective layer 27 may partially cover the substantially right half of the top surface of the thermal storage layer 13. The second protective layer 27 is provided for protecting the common electrode interconnection line 17, the individual electrode interconnection lines 19, the IC control interconnection line 23, and the ground electrode interconnection line 21 that are coated from oxidization by contact with the atmosphere and from corrosion due to, for example, adhesion of water in the air. Note that in order to more reliably protect the common electrode interconnection line 17, the individual electrode interconnection lines 19, and the IC control interconnection line 23, the second protective layer 27 may overlap the end of the first protective layer 25. The second protective layer 27 can be made of, for example, a resin material, such as epoxy resin or polyimide resin. In addition, the second protective layer 27 can be formed using, for example, a thick film forming technique such as a screen printing technique.

Note that an opening (not illustrated) is formed in the second protective layer 27 for allowing the ends of the individual electrode interconnection lines 19 connected to the drive IC's 11, the ends of a second middle area 21N and a third middle area 21L of the ground electrode interconnection line 21, and the end of the IC control interconnection lines 23 to be exposed therethrough, and these interconnection lines are connected to the drive IC's 11 through the opening. In addition, after the drive IC 11 is connected to the individual electrode interconnection line 19, the ground electrode interconnection line 21, and the IC control interconnection line 23, the drive IC 11 is covered and sealed by a cover members 29 made of resin, such as epoxy resin and silicon resin, in order to protect the drive IC 11 itself and a connection portion between the drive IC 11 and each of the interconnection lines.

As illustrated in FIG. 6, the FPC 5 is connected to the common electrode interconnection line 17, the ground electrode interconnection line 21, and the IC control interconnection line 23, as described above. The FPC 5 is an existing FPC in which a plurality of printed interconnection lines are wired inside an insulating resin layer, and each of the printed interconnection lines is electrically connected to an external power supply device and an external control device, which are not illustrated, via a connector 31 (refer to FIGS. 1 and 6).

More specifically, the printed interconnection lines formed inside are respectively connected to the end of the sub interconnection line portions 17*b* of the common electrode interconnection line 17, the end of the ground electrode interconnection line 21, and the end of the IC control interconnection lines 23 using solder paste 33 (refer to FIG. 3), and the FPC 5 connects the common electrode interconnection line 17, the ground electrode interconnection line 21, and the IC control interconnection lines 23 to the connectors 31.

Once the connector 31 is electrically connected to, for example, the external power supply device or the external control device which are not illustrated, the common electrode interconnection line 17 is connected to a plus terminal of the power supply device that is maintained at a positive potential of, for example, 20 to 24 V. The individual electrode interconnection lines 19 is connected to a minus terminal of the power supply device that is maintained at a ground potential of, for example, 0 to 1 V. Accordingly, when the switching element of the drive IC 11 is in an ON mode, an electric current is supplied to the heat generating members 9 and, thus, the heat generating members 9 generates heat.

In addition, like the common electrode interconnection line 17, when the connector 31 is electrically connected to, for example, the external power supply device or the external control device which are not illustrated, the IC power supply interconnection line 23*a* of the IC control interconnection lines 23 is connected to the plus terminal of the power supply device that is maintained at a positive potential. In this manner, an electric current for operating the drive IC 11 is supplied to the drive IC 11 due to a potential difference between the IC power supply interconnection line 23*a* to which the drive IC 11 is electrically connected and the ground electrode interconnection line 21.

Furthermore, the IC signal interconnection line 23*b* of the IC control interconnection lines 23 is connected to a control device that controls the drive IC 11. Thus, a control signal is transmitted from the control device to the drive IC 11 via the end signal interconnection line portion 23*b*E, and the control signal transmitted to the drive IC 11 is further transmitted to the neighboring drive IC via the middle signal interconnection line portion 23*b*M. By using the control signal for controlling ON mode/OFF mode of the switching element in the drive IC 11, one of the heat generating members 9 can be selectively generate heat.

Figure 8:
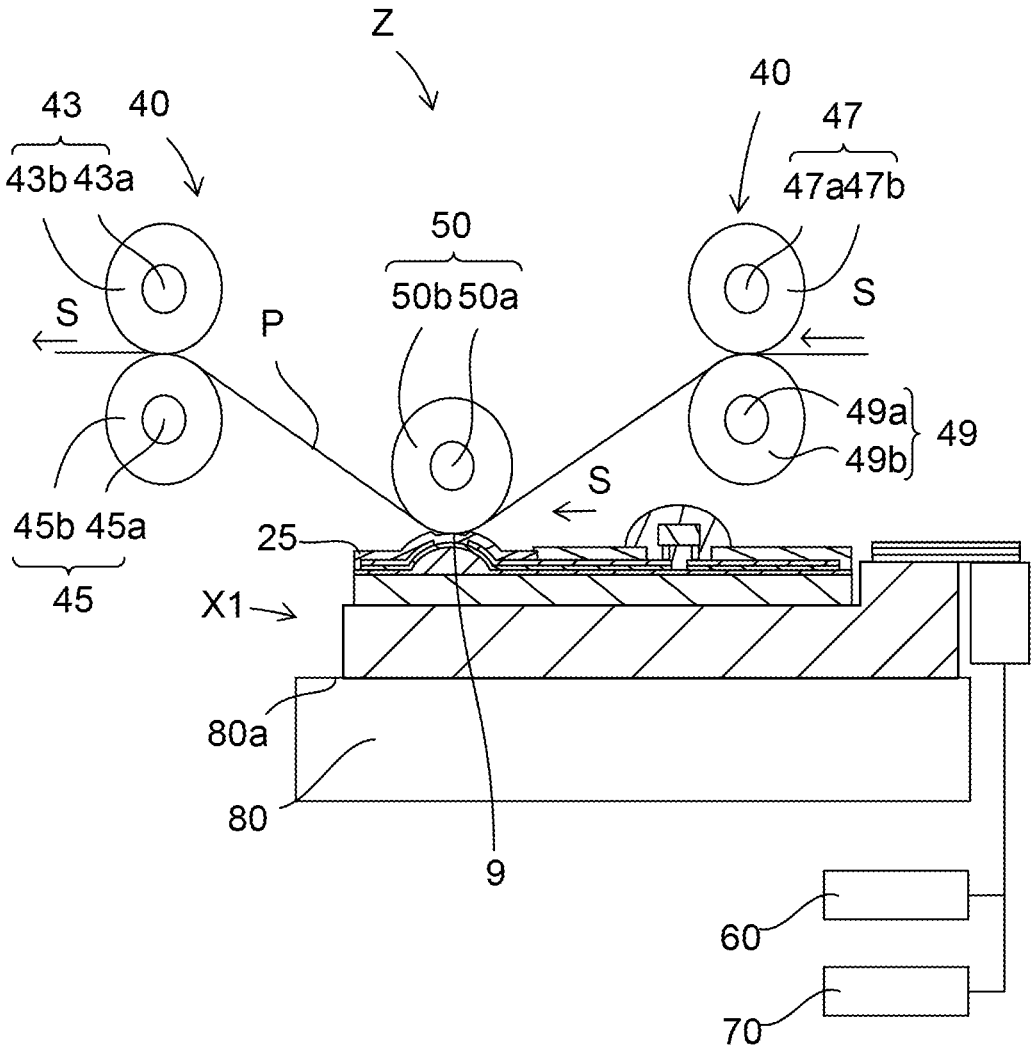
FIG. 8 is a schematic illustration of a schematic structure of a thermal printer according to an embodiment of the present invention.

A thermal printer according to an embodiment of the present invention is described next with reference to FIG. 8. FIG. 8 is a schematic illustration of the configuration of a thermal printer Z according to the present embodiment.

As illustrated in FIG. 8, the thermal printer Z according to the present embodiment includes the above-described thermal head X1, a transport mechanism 40, a platen roller 50, a power supply device 60, and a control device 70. The thermal head X1 is attached to an attachment surface 80*a* of an attaching member 80 provided on a chassis (not illustrated) of the thermal printer Z. Note that the thermal head X1 is attached to the attaching member 80 such that the arrangement direction of the heat generating members 9 is along a direction perpendicular to a transport direction S of a medium P to be described in more detail below (a main scanning direction)(a direction perpendicular to the plane of FIG. 8).

The transport mechanism 40 is provided for transporting the medium P such as a thermal paper and an image receiving paper onto which ink is transferred in the direction indicated by an arrow S in FIG. 8 to a point above the heat generating members 9 of the thermal head X (more precisely, a point above the protective layer 25), and includes transport rollers 43, 45, 47, and 49. For example, the transport rollers 43, 45, 47, and, 49 can be formed by covering cylindrical shaft bodies 43*a*, 45*a*, 47*a*, and 49*a* made of a metal, such as a stainless steel, with elastic members 43*b*, 45*b*, 47*b*, and 49*b* made of, for example, butadiene rubber. Note that although not illustrated, when the medium P is the image receiving paper on which ink is transferred, an ink film is transported together with the medium P between the medium P and the heat generating members 9 of the thermal head X1.

The platen roller 50 is provided for pushing the medium P against the heat generating members 9 of the thermal head X1, is disposed so as to extend in a direction perpendicular to the transport direction S of the medium P, and is supported at the ends thereof in a rotatable manner with the medium P pushing against the heat generating members 9. For example, the platen roller 50 can be formed by covering a cylindrical shaft body 50*a* made of a metal, such as a stainless steel, with an elastic member 50*b* made of, for example, butadiene rubber.

The power supply device 60 is provided for supplying an electric current for causing the heat generating members 9 of the thermal head X1 to generate heat in the above-described manner and an electric current for operating the drive IC's 11. The control device 70 is provided for supplying, to the drive IC's 11, control signals for controlling the operations performed by the drive IC's 11 so that the heat generating members 9 of the thermal head X1 are selectively generate heat in the above-described manner.

As illustrated in FIG. 8, while the thermal printer Z according to the present embodiment pushes a medium against the heat generating members 9 of the thermal head X1 using the platen roller 50 and transports the medium P to the heat generating members 9 using the transport mechanism 40, by selectively causing the heat generating members 9 to generate heat using the power supply device 60 and the control device 70, the thermal printer Z can perform predetermined printing on the medium P. Note that when the medium P is, for example, an image receiving paper, by thermally transferring ink of an ink film (not illustrated) that is transported together with the medium P onto the medium P, printing can be performed on the medium P.

Second Embodiment

Figure 9:
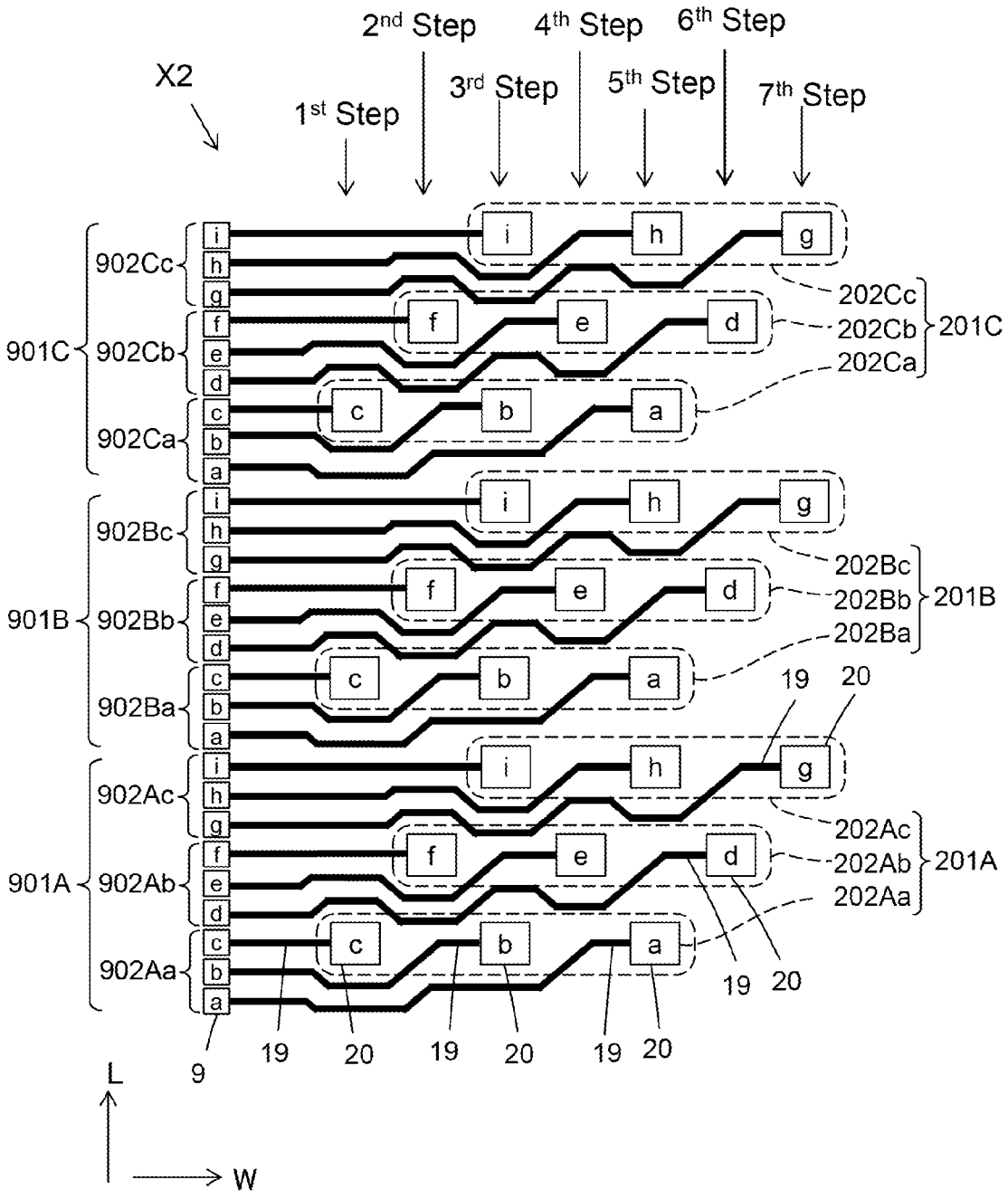
FIG. 9 is an enlarged view of an area corresponding to the H portion in FIG. 5 according to another embodiment of the present invention.

A thermal head X2 according to a second embodiment is described with reference to FIG. 9. The thermal head X2 is similar to the thermal head X1 in that first pad groups 201 are arranged in the first direction L and that second pad groups 202 are disposed in the first direction L and shifted to each other in the second direction W, but is different from the thermal head X1 in that the order in which each of the pads 20 that constitute the second pad group 202 is connected to one of the heat generating members 9.

Connection of the second pad groups 202Aa, 202Ab and 202Ac to the second heat generating member groups 902Aa, 902Ab, and 902Ac is described next.

The second pad group 202Aa is connected to the second heat generating members 902Aa, and the heat generating member 9*a* is connected to the pad 20*a* located in the fifth step. In addition, a heat generating member 9*b* that is adjacent to the heat generating member 9*a* is connected to the pad 20*b* located in the third step. Furthermore, the heat generating member 9*c* that is adjacent to the heat generating member 9*b* is connected to the pad 20*c* located in the first step. That is, the pads 20*a*, 20*b*, and, 20*c* that constitute the second pad group 202Aa are connected to the heat generating members 9*a*, 9*b*, and 9*c* in the order of the distance between the pads 20*a*, 20*b* and 20*c*, and the heat generating members 9*a*, 9*b* and 9*c* from longest to shortest. This also applies to the second pad groups 202Ab and 202Ac.

In addition, since the first pad groups 201A, 201B, and, 201C are arranged in the first direction L, small is the distance between the pad 20*i* connected to the heat generating member 9*i* that is arranged as the last heat generating member among the heat generating members 20*a* to 20*i* in the first heat generating member 901A and the pad 20*a* connected to the heat generating member 9*a* that is arranged as the last of the first heat generating member 901B.

Accordingly, compared to an existing configuration in which the pads 20 are diagonally disposed, the length of the individual electrode interconnection line 19 that connects the heat generating member 9*i* which is arranged last in the first heat generating member group 901A to the pad 20*i* can be made close to the length of the individual electrode interconnection line 19 that connects the heat generating member 9*a* which is arranged first in the first heat generating member group 901B to the pad 20*a*. As a result, the electrical resistances of the individual electrode interconnection lines 19 connected to the heat generating members 9*i* and 9*a*, which are disposed next to each other, can be made close to each other and, thus, the heating temperatures of the heat generating members 9*i* and 9*a* can be made close to each other.

The thermal head X1 has a difference in an electrical resistance of the individual electrode interconnection line 19 for 6 steps between the first pad group 201A and the first pad 201B corresponds to six steps, and in contrast, the thermal head X2 has, by using such arrangement of the pads 20, the difference in the electrical resistance of the individual electrode interconnection line 19 for two steps.

Third Embodiment

Figure 10:
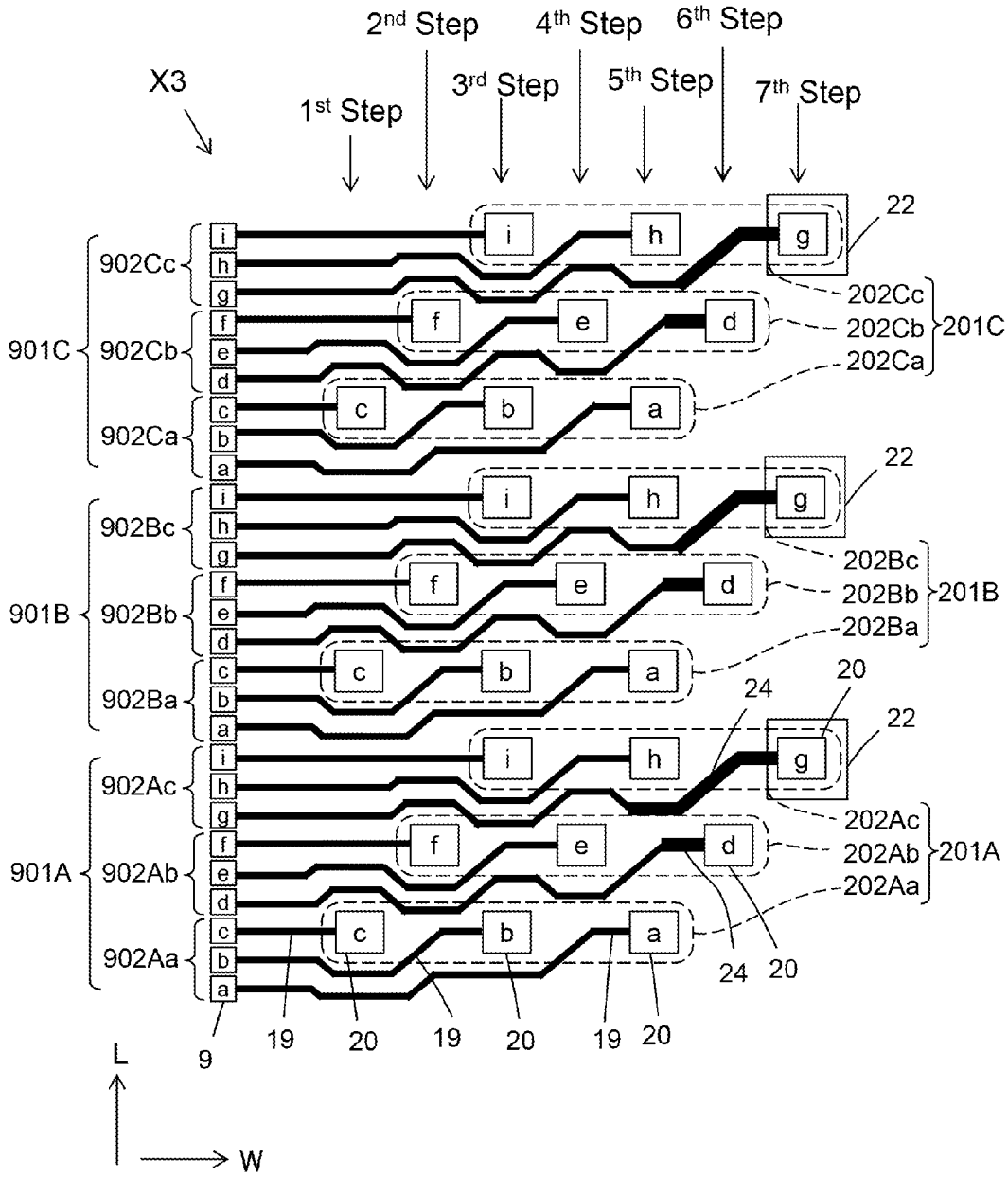
FIG. 10 is an enlarged view of an area corresponding to the H portion in FIG. 5 according to a modification of the other embodiment of the present invention.

A thermal head X3 according to a third embodiment is described with reference to FIG. 10. The thermal head X 3 is different from the thermal head X2 in that part of the individual electrode interconnection lines 19 is substituted by a wide width portion 24, an auxiliary electrode 22 is provided in the L direction of the pad on the pad disposed at the greatest distance from the heat generating members 9 among the pads 20 that constitute the first pad group 201, and the other configurations are the same as those of the thermal head X2.]

The wide width portion 24 is provided on some of the individual electrode interconnection lines 19 in the thermal head X3. More specifically, the wide width portion 24 is provided on the individual electrode interconnection lines 19 for the fifth step and the subsequent steps have. In this manner, an increase in an electrical resistance caused by an increase in the length of the individual electrode interconnection lines 19 can be reduced.

The wide width portion 24 is a portion wider than the other portions of the individual electrode interconnection lines 19, and has a capability of reducing the electrical resistance because of the wide width. The width of the wide width portion 24 may be changed in accordance with the position of the individual electrode interconnection lines 19, and is provided such that, for example, the width of the wide width portion 24 provided in the fifth step may be larger than the width portion 24 provided in the fourth step. Since the margin of the placement area of the pad 20 increases as the pad 20 is located farther away from the heat generating members 9 in the second direction W, it is preferable that the wide width portions 24 increase toward the second direction.

In addition, in the thermal head X3, the auxiliary electrode 22 are provided on the pads 20*a*, 20*d*, and 20*g* that constitute the first pad groups 201A, 201B, and, 201C.

When a probe process is performed after probe needles are positioned at pads on the side of the heat generating members, it is possible to create defective products by detection failures when the probe needles do not contact with pads located far from the heat generating members.

In contrast, in the thermal head X3, the auxiliary electrode 22 is provided on the pads 20*a*, 20*d*, and 20*g* that constitute the first pad groups 201A, 201B, and, 201C and therefore, even when the positions of the probe needles to be contact with the pads 20*a*, 20*d*, and 20*g* are shifted a little, the probe test can be accurately performed, and the probability of a good pad being detected as a defective pad can be reduced.

The auxiliary electrode 22 can be formed of a material that is the same as the individual electrode interconnection lines 19, and can be formed at the same time as the individual electrode interconnection lines 19 is formed. Note that the auxiliary electrode 22 may be formed integrally with the individual electrode interconnection line 19. That is, the sizes of the pads 20*a*, 20*d*, and 20*g* that constitute the first pad groups 201A, 201B, and, 201C may be made larger than the sizes of the other pads 20.

Note that as described above, even though in some cases, Ni or AI, for example, is plated on the pads 20, plating is not necessarily performed on the auxiliary electrode 22. Even when plating is not performed on the auxiliary electrode 22, the probability of detecting a defective pad during the probe process can be reduced.

In addition, while the above description has been made with reference to the thermal head X3 having the auxiliary electrodes 22 for only the pads 20*a*, 20*d*, and 20*g* located in the seventh step, the configuration is not limited thereto. For example, the auxiliary electrode 22 may be provided for the pads 20*a*, 20*b*, 20*h*, and 20*g* in the fifth step and the subsequent steps. Furthermore, among the pads 20 that constitute the second pad group 202, the auxiliary electrode 22 may be provided in the pads 20*a*, 20*d*, and 20*g* that are the farthest from the heat generating members 9. In the above-described two cases, the probability of detecting a defective pad during the probe process can be reduced.

Fourth Embodiment

Figure 11:
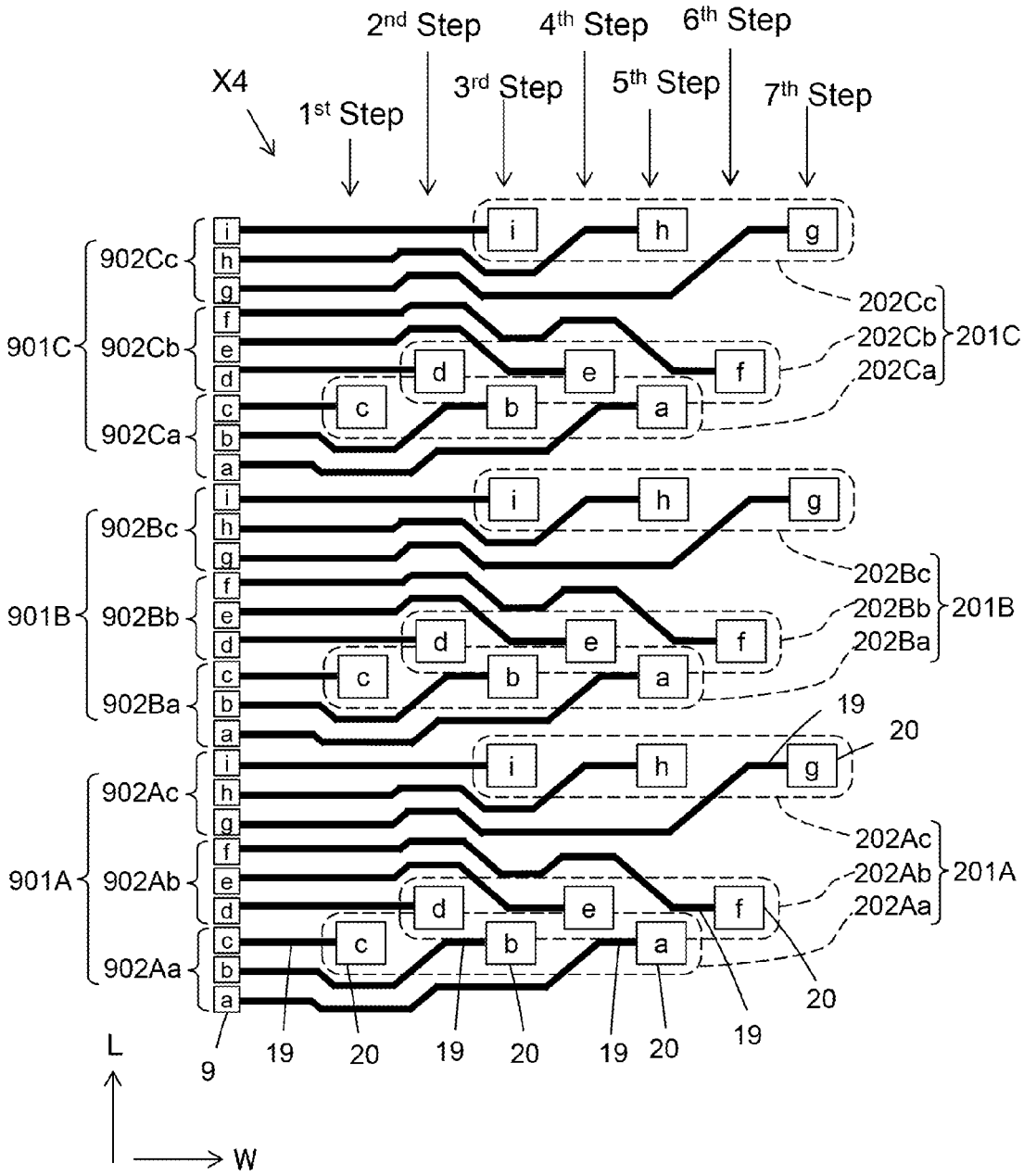
FIG. 11 is an enlarged view of an area corresponding to the H portion in FIG. 5 according to still another embodiment of the present invention.

A thermal head X4 according to a fourth embodiment is described with reference to FIG. 11. In terms of the first pad group 201A of the thermal head X4, in the second pad groups 202Aa and 201Ac of the first pad group 201A, the heat generating members 9 are connected to the pads 20 in the order from the largest distance between the heat generating members 9 and the pad 20 to the smallest. In the second pad group 202Ab, it is configured that the heat generating members 9 are connected to the pads 20 in the order from the smallest distance between the heat generating members 9 and the pad 20 to the largest. The other configurations are the same as those of the thermal head X1 and, thus, descriptions of the other configurations are not repeated.

Connections between the heat generating members 9 and the pads 20 of the thermal head X4 are described below with reference to the first pad group 201A. A first distance between a heat generating member 9*a* and a pad 20*a* is larger than a second distance between a heat generating member 9*b* and a pad 20*b*. The second distance is larger than a third distance between a heat generating member 9*c* and a pad 20*c*. Accordingly, the distances between the heat generating members 9*a*, 9*b* and 9*c* and the pads 20*a*, 20*b* and 20*c* is getting shorter as moving toward the first direction L in the first pad group 202Aa.

A fourth distance between a heat generating member 9*d* and a pad 20*d* is shorter than a fifth distance between a heat generating member 9*e* and a pad 20*e*. The fifth distance is shouter than a sixth distance between a heat generating member 9*f* and a pad 20*f*. Accordingly, it is configured that the distances between the heat generating members 9*d*, 9*e* and 9*f* and the pads 20*d*, 20*e* and 20*f* is getting longer as moving towards the first direction L in the first pad group 202Ab.

In addition, a seventh distance between a heat generating member 9*g* and a pad 20*g* is larger than a eighth distance between a heat generating member 9*h* and a pad 20*h*. The eighth distance is larger than a ninth distance between a heat generating member 9*i* and a pad 20*i*. The pads 20*g*, 20*h*, and 20*i* that constitute the second pad group 202Ac are connected to the heat generating members 9*g*, 9*h*, and 9*i*, respectively, in the order from the largest distance between the heat generating members 9 and the pads 20 to the smallest. Accordingly, it is configured that the distances between the heat generating members 9*g*, 9*h* and 9*i* and the pads 20*g*, 20*h* and 20*i* are getting shorter as moving towards the first direction L. That is, in the thermal head X4, the heat generating members 9 and the pads 20 are electrically connected so as to meander toward the first direction L.

Since the thermal head X4 has such a configuration, when the second pad group 202Aa is connected to the heat generating members 9, the distances between the heat generating members 9 and the pad 20 gradually decrease toward the first direction L from the length in the fifth step to the length to the second step. When the second pad group 202Ab is connected to the heat generating members 9, the distances between the heat generating members 9 and the pads 20 gradually increase from the length in the third step to the length in the sixth step. When the second pad group 202Ac is connected to the heat generating members 9, it is configured that the distances between the heat generating members 9 and the pads 20 gradually decrease from the length in the seventh step to the length in the third step.

In this manner, the distances between the heat generating members 9 and the pads 20 continuously change as moving toward the first direction L, thereby making the electrical resistances of the individual electrode interconnection lines 19 for the neighboring heat generating members 9 close to each other. Accordingly, the heating temperatures of the neighboring heat generating members 9 can be made close to each other.

In addition, since the first pad groups 201A, 201B, and, 201C are arranged in the first direction L, the electrical resistances of the individual electrode interconnection lines 19 for the neighboring heat generating members 9 between the first pad groups 201A, 201B, and, 201C can be made close to each other. Accordingly, the heating temperatures of the neighboring heat generating members 9 can be made close to each other.

More specifically, the pad 20*i* connected to the heat generating member 9*i* located last in the first pad group 201A is positioned in the third step, and the pad 20*a* connected to the heat generating member 9*a* located first in the first pad group 201B is positioned in the fifth step. Accordingly, even at the boundary between the first pad groups 201, the electrical resistances for the neighboring heat generating members 9 can be made close to each other.

Note that description has been made with reference to the position of the pad 20*i* connected to the heat generating member 9*i* located last in the first pad group 201A being in the third step and the position of the pad 20*a* connected to the heat generating member 9*a* located first in the first pad group 201B being in the fifth step, the configuration is not limited thereto. For example, by shifting the first pad group 201B in a direction opposite to the second direction W by two steps, the position of the pad 20*i* connected to the heat generating member 9*i* located last in the first pad group 201A may be next to the position of the pad 20*a* connected to the heat generating member 9*a* located first in the first pad group 201B. In this manner, a difference in electrical resistances between the electrical resistances of the individual electrode interconnection lines 19 in the first pad groups 201 can be reduced more. That is, a difference in electrical resistances of an individual electrode interconnection line 19 connecting 9*i* with 20*i* and an individual electrode interconnection line 19 connecting 9*a* with 20*a* can be reduced. Note that when the pads 20 are disposed next to each other, it is preferable that the pads 20 be disposed in the same step. That is, it is preferable that the distances between the heat generating members 9 and the pads 9 be the same. In this manner, a difference between the electrical resistances of the neighboring pads 20 can be reduced.

While the present invention has been described with reference to the embodiments, the scope of the invention should not be construed as being limited by the embodiment. Various modifications can be made without departing from the scope of the present invention.

For example, while the above-described embodiment has been described with reference to the thermal head X1 having the rectangular pads 20, as illustrated in FIG. 7, the shape is not limited thereto. The pads 20, for example, may have any polygonal shape or a circular shape.

In addition, in the thermal head X1 according to the above-described embodiment, although each of the first heat generating member groups 901 is constituted by nine heat generating members 9, each of the second heat generating member groups 902 is constituted by three heat generating members 9, and these are respectively connected to the first heat generating member groups 901 and the second heat generating member groups 902 as illustrated in FIG. 7, a number of the plurality of heat generating members 9 that configure the first heat generating member group 901 and the second heat generating member group 902 may be any number more than one. Furthermore, the number of the first pad groups 201 and the number of the second pad groups 202 may be determined in accordance with the number of the plurality of heat generating members 9 that constitute the first heat generating member group and the second heat generating member groups.

Still furthermore, while the first direction L is perpendicular to the second direction W in the thermal head X1, the configuration is not limited thereto. Since it is enough that the second pad groups are arranged in a direction farther away in the first direction L, it is only required that the second direction W differs from the first direction L.

DESCRIPTIONS OF REFERENCE NUMERALS

X1, X2, X3, X4 thermal head
1 heat dissipator
3 head substrate
7 substrate
9 heat generating member
901 first heat generating member group
902 second heat generating member group
11 drive IC
11*a* first connection terminal
11*b* second connection terminal
13 thermal storage layer
13*b* raised portion
15 electrical resistance layer
17 common electrode interconnection line
19 individual electrode interconnection line
20 pad
201 first pad group
202 second pad group
22 auxiliary electrode
24 wide width portion
25 first protective layer
27 second protective layer
L first direction
W second direction

What is claimed is:

1. A thermal head comprising:

a substrate;

a plurality of heat generating members disposed on the substrate and arranged in a first direction;

a plurality of pads disposed on the substrate; and a plurality of interconnection lines disposed on the substrate, the interconnection lines each electrically connecting each of the heat generating members to one of the pads, wherein the plurality of pads are arranged in a first direction and constitute a plurality of first pad groups, each first pad group comprising a plurality of second pad groups, and wherein the second pad groups are arranged in the first direction so as to be shifted from each other in a second direction that differs from the first direction, and each second pad group comprises a plurality of pads.

2. The thermal head according to claim 1, wherein in the first pad groups, distances each between the pad located closest to the heat generating member among the pads that constitute the second pad groups and the heat generating member increase in the first direction.

3. The thermal head according to claim 1, wherein the heat generating members constitute a plurality of first heat generating member groups electrically connected to the first pad groups and a plurality of second heat generating member groups constituted by the heat generating member that constitute the first heat generating member group and electrically connected to the second pad groups, and the pads that constitute the second pad group are electrically connected to the consecutive heat generating members that constitute the second heat generating member group in the order from the longest distance between the pad and the heat generating member to the shortest.

4. The thermal head according to claim 1, wherein the widths of the interconnection lines increase as the distance between the pad and the heat generating member.

5. A thermal printer comprising:

the thermal head according to claim 1;

a transport mechanism configured to transport a medium to a point above the plurality of heat generating members; and a platen roller configured to urge the medium against the heat generating members.

6. The thermal head according to claim 1, wherein the plurality of first pad groups comprise the same arrangement of the pads with respect to each other, and are disposed repeatedly in the first direction.

7. The thermal head according to claim 1, wherein distances between the heating members and the pads vary continuously as moving toward the first direction.

8. The thermal head according to claim 1, wherein the plurality of pads meander toward the first direction.

9. The thermal head according to claim 1, wherein the plurality of interconnection lines partially comprise a wide width portion.

10. The thermal head according to claim 1, wherein the pad having the longest distance from the heat generating member among the plurality of pads constituting the first pad groups has a size bigger than sizes of the other pads.

11. The thermal head according to claim 1, wherein the second pad groups further comprise:

one second pad group comprising a first pad and a second pad, the second pad disposed next to the first pad; and another second pad group comprising a third pad, the another second pad group disposed next to the one second pad group, wherein the third pad is located between the first pad and the second pad as viewed in the first direction.

12. The thermal head according to claim 1, wherein the first pad groups further comprise:

one first pad group comprising a first pad; and another first pad group comprising a second pad, the another first pad group disposed next to the one first pad group, and the heat generating members further comprise:

a first heat generating member electrically connected to the first pad; and a second heat generating member electrically connected to the second pad, the second heat generating member disposed next to the first heat generating member.

13. A thermal head comprising:

a substrate;

first and second heat-generating systems directly-aligned in a first direction on the substrate, each system comprising:

a first heating group, comprising:

first and second heating members disposed next to each other;

first and second pads disposed next to each other;

a first interconnection line electrically connecting the first heating member to the first pad; and a second interconnection line electrically connecting the second heating member to the second pad, wherein the first heating member, the first pad and the second pad are directly-aligned in a second direction perpendicular to the first direction, a first distance between the first heating member and the first pad is shorter than a second distance between the first heating member and the second pad, a second heating group, comprising:

third and fourth heating members disposed next to each other;

third and fourth pads disposed next to each other, a third interconnection line electrically connecting the third heating member to the third pad; and a fourth interconnection line electrically connecting the fourth heating member to the fourth pad, wherein the third heating member, the third pad and the fourth pad are directly-aligned in the second direction, a third distance between the third heating member and the third pad is longer than the first distance and shorter than the second distance, a fourth distance between the third heating member and the fourth pad is longer than the second distance, and the first, second, third and fourth heating members are directly-aligned in the first direction.

14. The thermal head according to claim 13, wherein each of the first and second heat-generating systems further comprising a third heating group, the third heating group comprising:

fifth and sixth heating members disposed next to each other;

fifth and sixth pads disposed next to each other, a fifth interconnection line electrically connecting the fifth heating member to the fifth pad; and a sixth interconnection line electrically connecting the sixth heating member to the sixth pad, wherein the fifth heating member, the fifth pad and the sixth pad are directly-aligned in the second direction, wherein a fifth distance between the fifth heating member and the fifth pad is longer than the third distance and shorter than the fourth distance, a sixth distance between the fifth heating member and the sixth pad is longer than the fourth distance, and the first, second, third, fourth, fifth and sixth heating members are directly-aligned in a first direction.

15. The thermal head according to claim 13, wherein the first heating group further comprises:

a fifth heating member between the second heating member and the third member;

a fifth pad next to the second pad; and a fifth interconnection line electrically connecting the fifth heating member to the fifth pad, wherein the first heating member, the first pad, the second pad and the fifth pad are directly-aligned in the second direction, and a fifth distance between the first heating member and the fifth pad is longer than the fourth distance, and the second heating group further comprises:

a sixth heating member next to the fourth heating member;

a sixth pad next to the fourth pad; and a sixth interconnection line electrically connecting the sixth heating member to the sixth pad, wherein a sixth distance between the third heating member and the sixth pad is longer than the fifth distance, the third heating member, the third pad, the fourth pad and the sixth pad are directly-aligned in the second direction, and the first, second, third, fourth, fifth and sixth heating members are directly-aligned in the first direction.

* * * * *